US005829083A

United States Patent [19]

Sutton

[11] Patent Number: 5,829,083

[45] Date of Patent: Nov. 3, 1998

[54] DEVICE AND METHOD USED IN WASHING A BRASSIERE

[76] Inventor: John T. Sutton, 15 St. John, Monarch Beach, Calif. 92629

[21] Appl. No.: 859,537

[22] Filed: May 20, 1997

[51] Int. Cl.[6] ..... D06F 1/12

[52] U.S. Cl. ..... 8/150; 68/235 R

[58] Field of Search ..... 8/150; 68/235 R, 68/212, 213

[56] References Cited

U.S. PATENT DOCUMENTS

| | | | |
|---|---|---|---|
| 850,697 | 4/1907 | Voss | 68/235 R X |
| 2,786,346 | 3/1957 | Brandenburg | 68/213 |
| 2,786,347 | 3/1957 | Whitlock | 68/213 |
| 3,769,819 | 11/1973 | Contreras | 68/235 R X |

FOREIGN PATENT DOCUMENTS

| | | | |
|---|---|---|---|
| 120895 | 6/1987 | Japan | 68/235 R |
| 486808 | 3/1976 | U.S.S.R. | 68/213 |

*Primary Examiner*—Philip R. Coe

*Attorney, Agent, or Firm*—John J. Connors; Connors & Assoc.

[57] ABSTRACT

A device 10 is used during washing of a brassiere 24 to protect the brassiere and maintain the shape of the cups 24*a* and 24*b* of the brassiere. It includes an inner spherical framework 12 contained within a larger outer spherical framework 14. Each framework is formed by a pair of hemispherical sections that upon being coupled together form the individual frameworks. With the inner framework 12 open, the brassiere 24 is fitted over the hemispherical sections, with one section being placed inside each cup of the brassiere. The sections of the inner framework 12 with the brassiere thereon are then closed and placed inside an open outer framework 14. The outer framework 14 is then closed to enclose the inner framework 12, and the assembly of frameworks is placed into a washing machine. The inner and outer frameworks are open structures that allow water to flow thereto during washing.

20 Claims, 16 Drawing Sheets

FIG. 4b
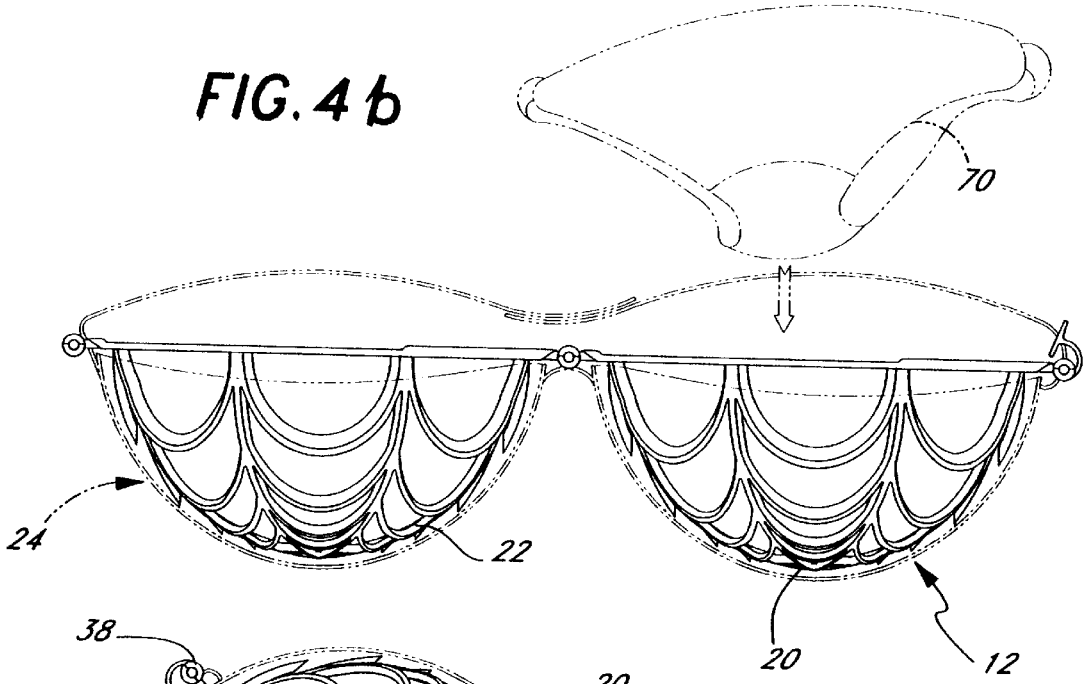
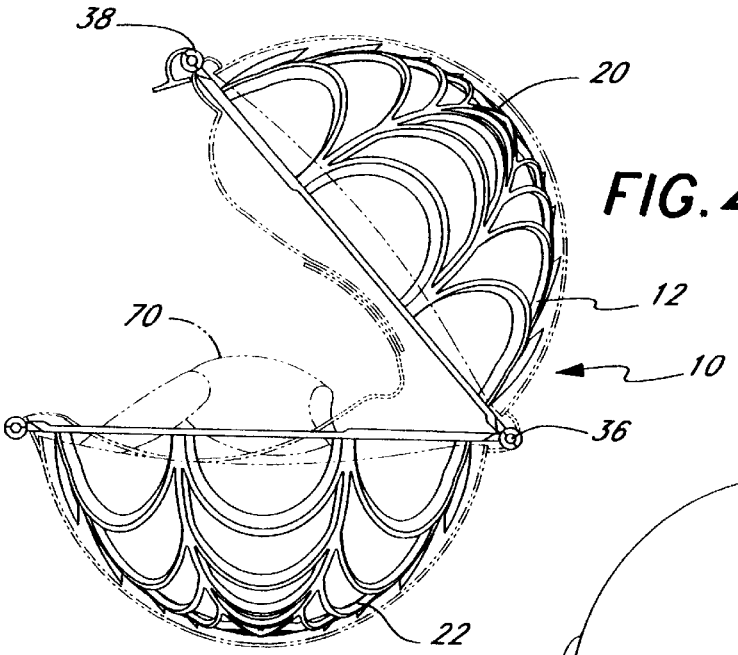
FIG. 4c
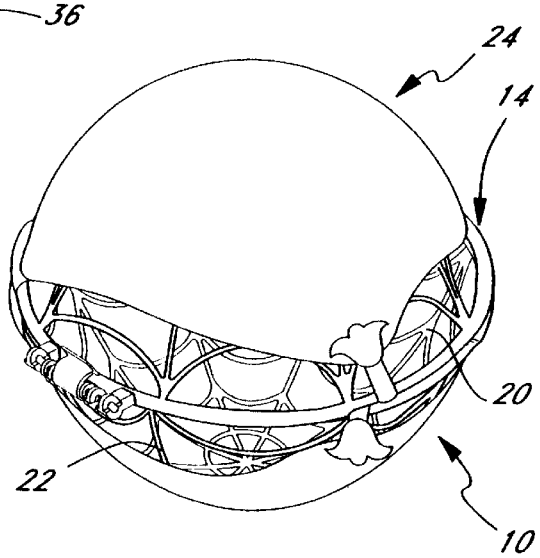
FIG. 4d

FIG.15
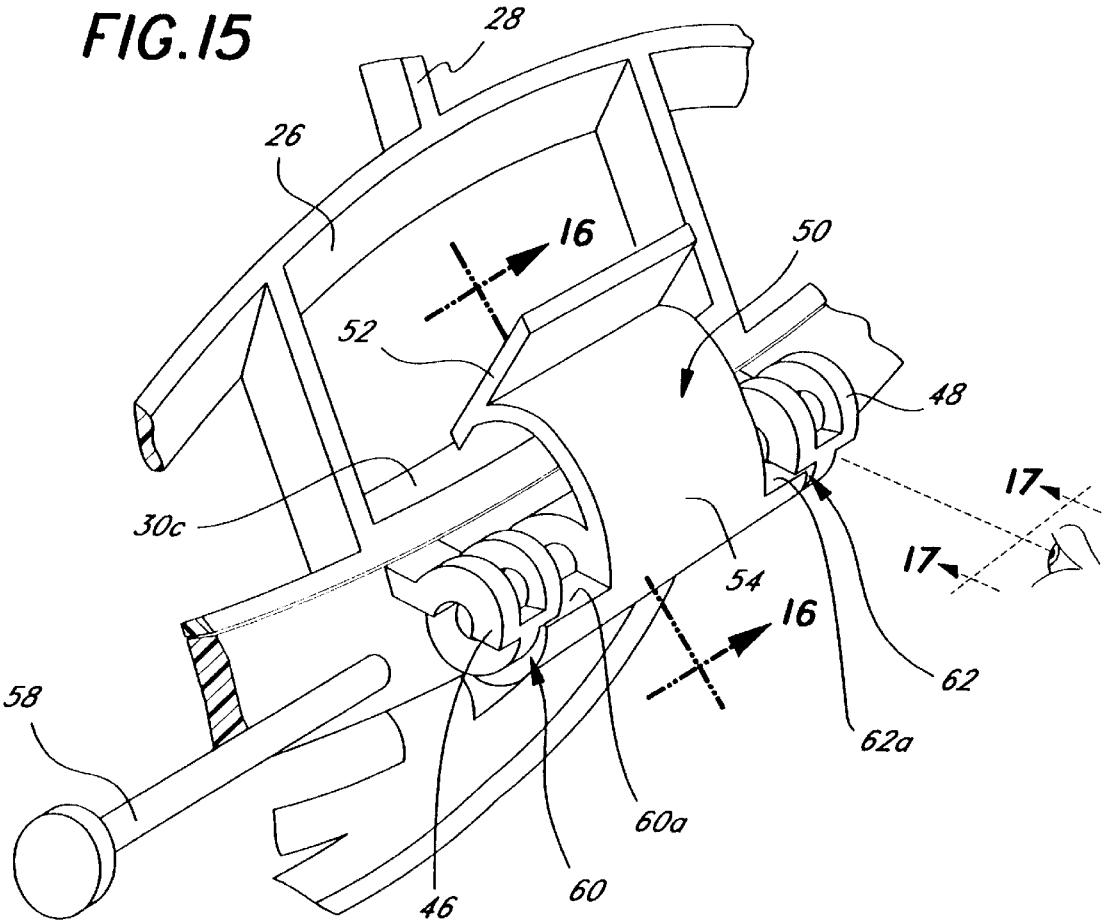
FIG.16
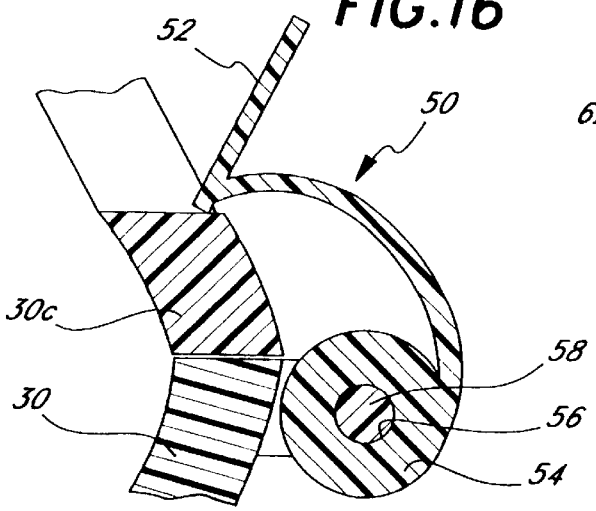
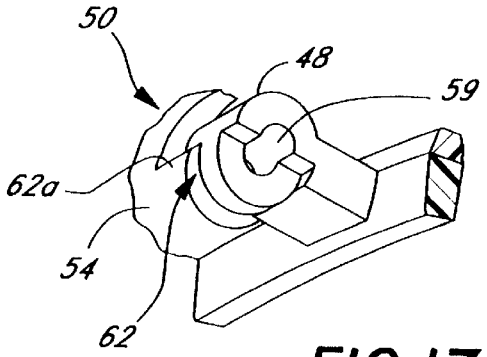
FIG.17

DEVICE AND METHOD USED IN WASHING A BRASSIERE

BACKGROUND OF THE INVENTION

1. Field of the Invention

This invention relates to a method and device used during washing of a brassiere to protect the brassiere so that it maintains its shape.

2. Background Discussion

There is need to hold a brassiere on a support structure while washing in a washing machine so that the delicate padded cups of the brassiere are not deformed or damaged. This is especially important when the brassiere uses wire supports, which bend during washing. Moreover, the brassiere becomes entangled with other garments, and its shape is contorted. Ideally, a suitable device will be simple to manufacture and use. It should will be rugged, yet still protect the brassiere. And most importantly, it should be able to withstand the rough action encountered during washing in a washing machine and still allow the water to penetrate the brassiere and wash it thoroughly.

SUMMARY OF THE INVENTION

It is the objective of this invention to provide a method and device used during washing of a brassiere in a washing machine to protect the brassiere, especially the cups of the brassiere so that they maintains their shape.

The device of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include protection of a brassiere during washing in a washing machine, prevention of deformation of the cups of the brassiere during washing in a washing machine, and a rugged construction which is simple to manufacture and use.

The first feature of the device of this invention is that it includes an inner framework over which the brassiere fits, and an outer framework in which the inner framework is contained. The outer framework includes sections that are coupled together, which provide an enclosure for the inner framework. When uncoupled, these sections open to receive the inner framework with the brassiere thereon. Both the inner and outer frameworks are open structures that allow water to flow thereto during washing.

The second feature is that both the outer framework and the inner framework each have a substantially spherical configuration. The inner framework includes two substantially hemispherical sections, enabling a cup of the brassiere to fit snugly over each one of the hemispherical sections. The substantially hemispherical sections have the general shape of a breast, and are adapted to support the cups of a brassiere in a manner that retains the shape of the cups during washing in a washing machine. The sections may be each separately molded from a polymeric material, or pairs of sections may be joined together by a living hinge formed during molding. If formed as separate units, the two sections each have complementary hinge mechanisms that enable the sections to be connected by this hinge mechanism. The preferred polymeric material is a copolymer of polypropylene and polyethylene, polypropylene, or polyethylene.

The third feature is that each pair of hemispherical sections includes a latching mechanism for coupling together the two sections.

This invention also includes a method of washing a brassiere in a washing machine. This method includes the steps of (a) providing a device for protecting the brassiere, which has an inner framework over which the brassiere fits, and an outer framework in which the inner framework is contained, said outer framework including a plurality of sections that are coupled together, the sections, when coupled together, providing an enclosure for the inner framework and, when uncoupled, opening to receive the inner framework with the brassiere thereon, said inner and outer frameworks being open structures that allow water to flow thereto during washing, (b) fitting the brassiere over the inner framework, (c) after uncoupling the pair of sections of the outer framework, placing the inner framework with the brassiere thereon into the outer framework and coupling the pair of sections together to enclose the inner framework in the outer framework, and (d) placing in the washing machine the device with the outer framework enclosing the inner framework with the brassiere thereon.

DESCRIPTION OF THE DRAWING

The preferred embodiments of this invention, illustrating all its features, will now be discussed in detail. These embodiments depict the novel and non-obvious method and device of this invention as shown in the accompanying drawing, which is for illustrative purposes only. This drawing includes the following figures (FIGS.), with like numerals indicating like parts:

FIG. 4*b* is a side elevational view showing the inner framework open with the brassiere fitted over it, and delicate garments such as panties being placed within one of the hemispherical sections of the inner framework.

FIG. 4*c* is side elevational view showing the two hemispherical sections of the inner framework being closed to hold the brassiere on the external surface area of the framework and the panties contained within the closed framework.

FIG. 4*d* is a perspective view of the inner framework completely closed with the brassiere fitted snugly around its external surface.

FIG. 15 is a perspective view of the latching mechanism used to detachably connect the hemispherical sections of either the inner or outer frameworks together.

FIG. 16 is a cross-sectional view taken along line 16—16 of FIG. 15.

FIG. 17 is a perspective view of one of the elements of the latching mechanism shown in FIG. 15.

DETAILED DESCRIPTION OF THE PREFERRED EMBODIMENTS

Figure 1:
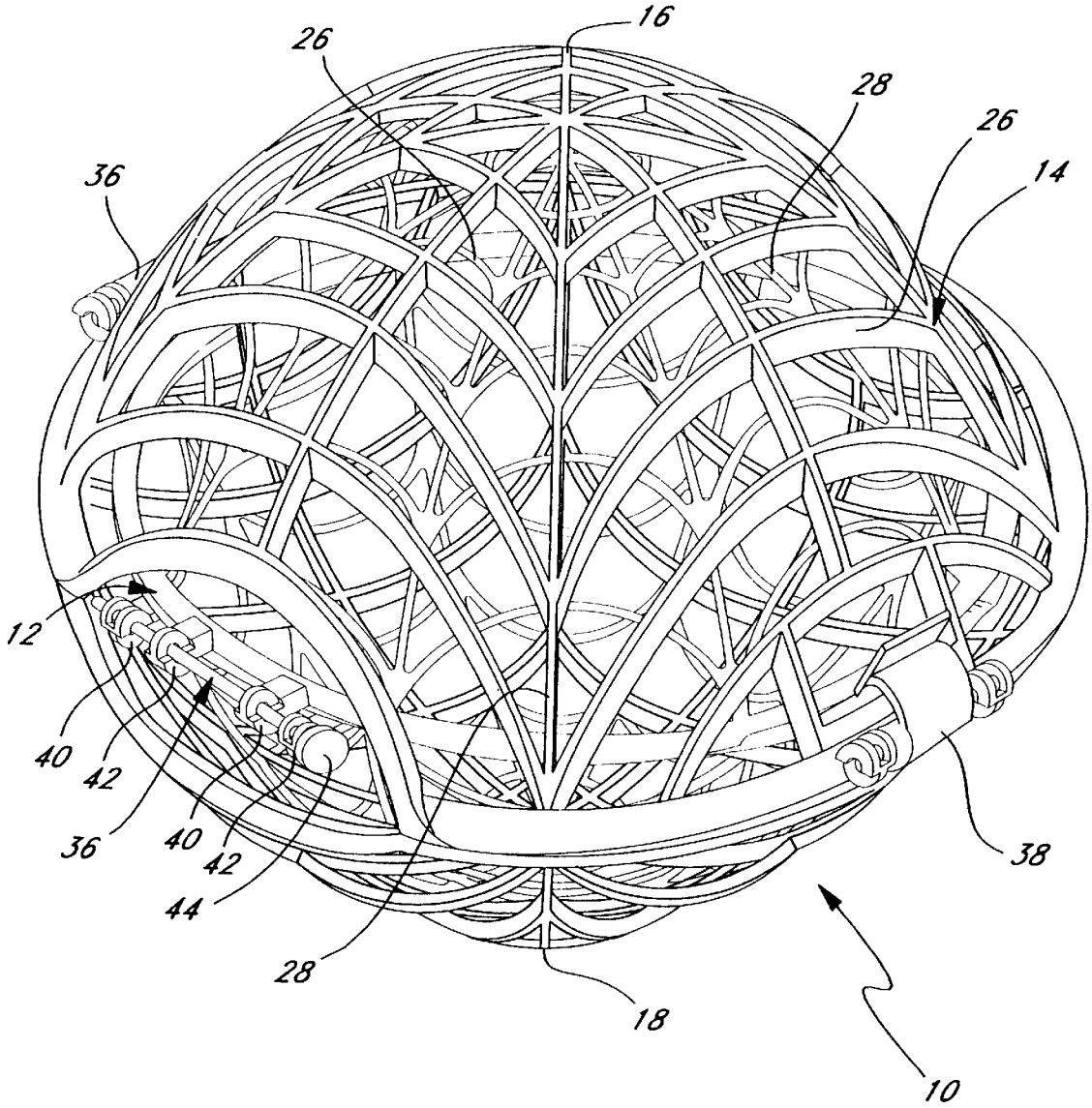
FIG. 1 is a perspective view of the protective device of this invention including an inner framework contained in an outer spherical framework.
Figure 2:
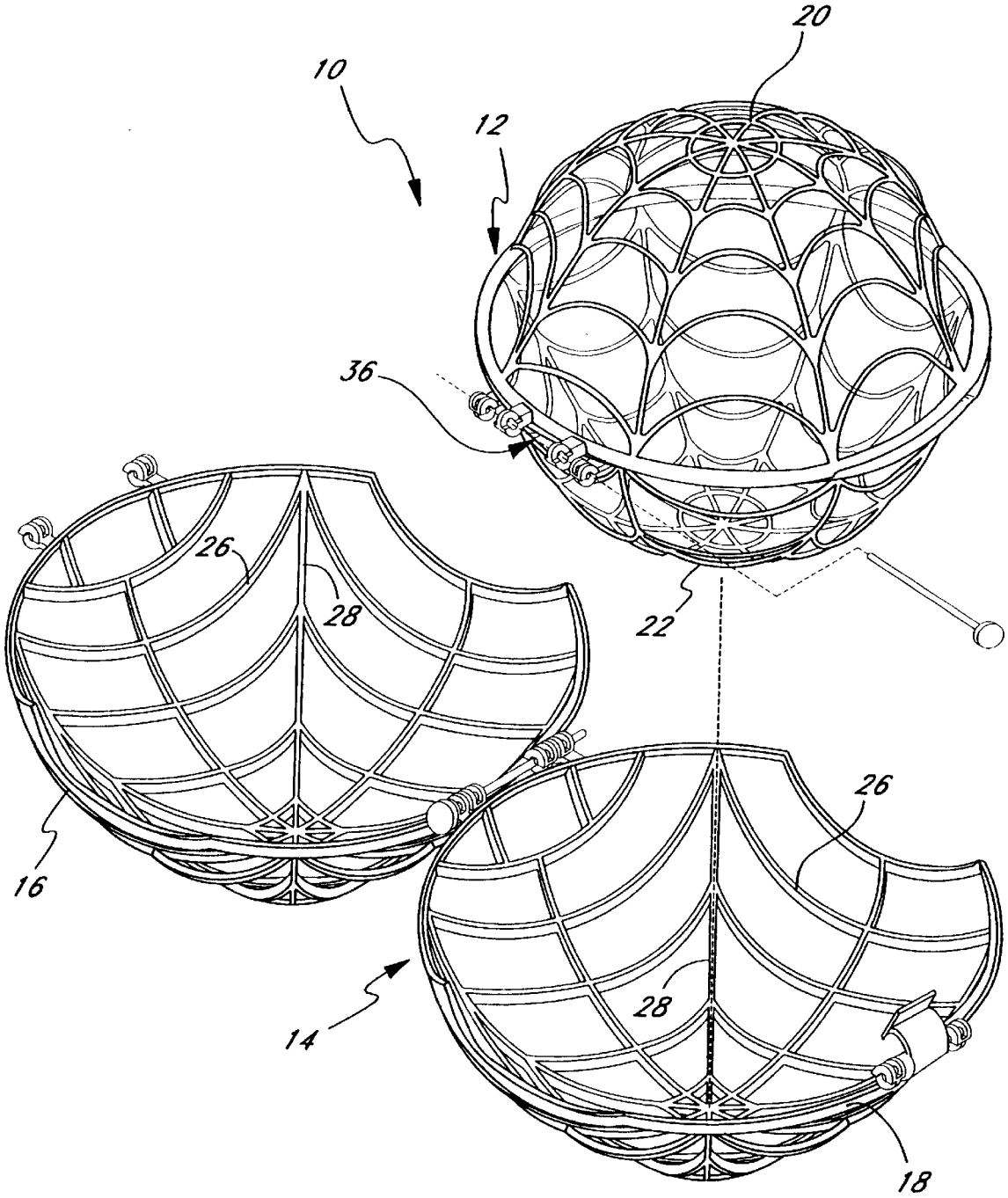
FIG. 2 is an exploded perspective view showing the outer framework open and the inner spherical framework positioned to be inserted in the open outer framework.
Figure 3:
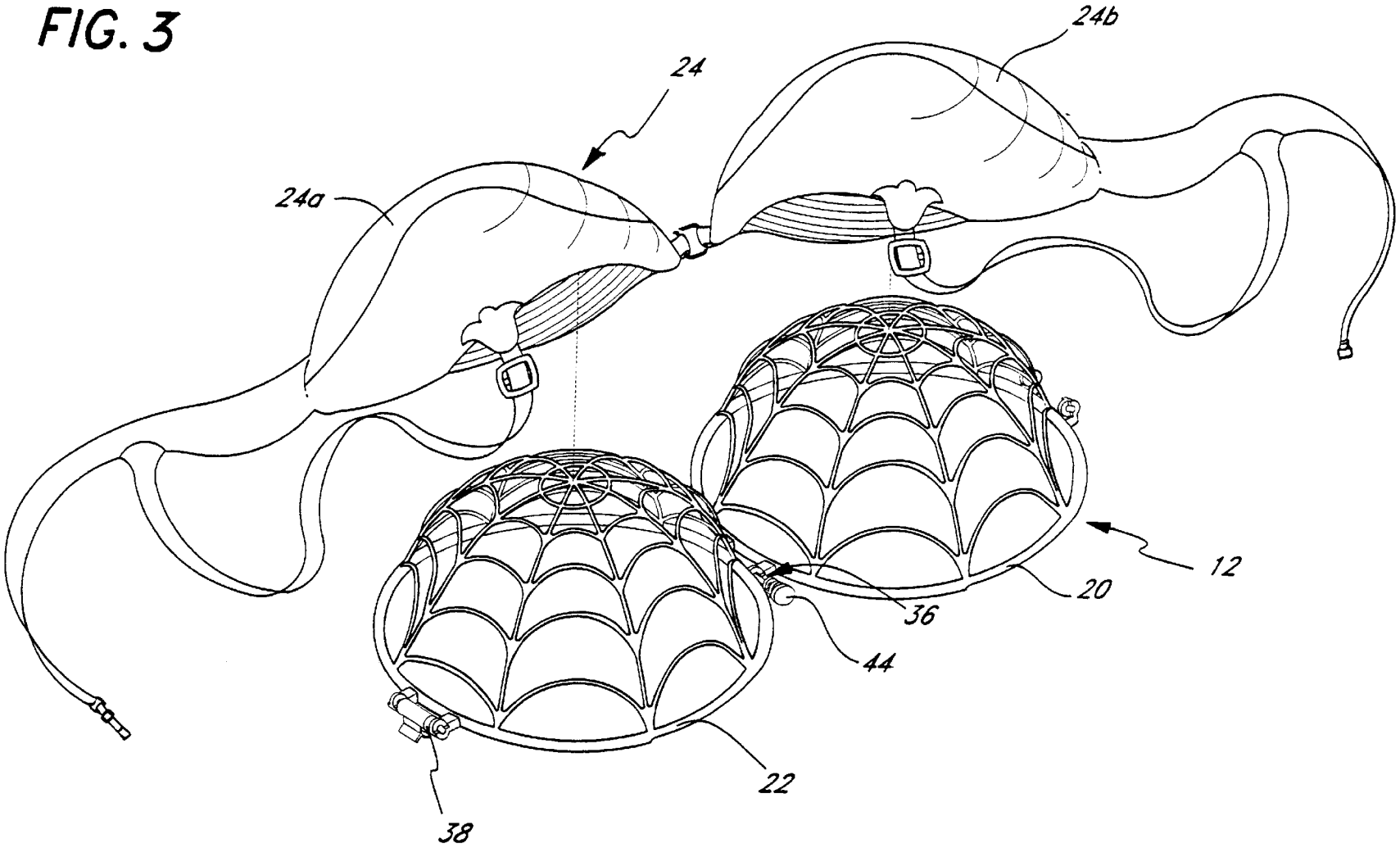
FIG. 3 is a perspective view showing the inner framework opened with its hemispherical sections hinged together and positioned to fit within the individual cups of the brassiere.

As best shown in FIGS. 1 through 5*b*, the device 10 for protecting brassieres includes an inner, substantially spherical framework 12 contained within an outer, substantially spherical framework 14. The outer framework 14 includes a pair of substantially hemispherical sections 16 and 18 (FIGS. 2 and 5*a*) which are coupled together so that they may be closed to form the outer framework. The inner framework 12 also includes a pair of substantially hemispherical sections 20 and 22 (FIGS. 3 and 4*a*) which are coupled together so that they may be closed to form the inner framework. The outer framework 14 has a diameter sufficiently larger than the diameter of the inner framework 12 so the inner framework, with a brassiere 24 fitted over it as depicted in FIG. 4*d*, can be placed within the outer framework. Typically, the diameter of the outer framework ranges between about 6 and 7 inches, and the diameter of the inner framework ranges between about 5 and 6.5 inches. The preferred difference between these diameters is from about ¼ to about ½ inch. These ranges of diameters enable the device 10 to be used with many different cup sizes of the brassiere 24.

Each hemispherical section 16, 18, 20, and 22 is made of a polymeric material that may be injected molded using conventional manufacturing techniques. The preferred polymeric material may be, for example, a copolymer of polypropylene and polyethylene, polypropylene, or polyethylene. Each hemispherical section 16, 18, 20, and 22 includes a series of spaced apart ribs 26 which extend between a series of spaced apart arches 28. The arches 28 terminate at one end at a circumferential rim 30 and at the other end come together at the apex 32 of their respective hemispherical sections. The number and shape of the arches and ribs for the inner and outer frameworks 12 and 14 are different to assist in distinguishing these frameworks. The colors of these frameworks 12 and 14 may also be different to assist in distinguishing these frameworks.

Each rim 30 of the hemispherical sections 16 and 18 of the outer framework 14 has inward bent portions 30*a* and 30*b* (FIG. 7) at opposite locations to provide opposed access openings 33 and 35 (FIGS. 5*b* and 6), respectively, for a hinge mechanism 36 and a latch mechanism 38 of the inner framework 12. Thus, when these hemispherical sections 16 and 18 are connected to form the outer spherical framework 14, there is provided the pair opposed openings 33 and 35 in the outer framework for a coupling mechanisms of the inner framework 12 comprising the hinge mechanism 36 and the latch mechanism 38. This hinge mechanism 36 and latch mechanism 38 are, respectively, received within these openings 33 and 35 when the inner framework 12 is placed in the outer framework 14 as depicted in FIGS. 1, 2, 5*b*, and 6.

Both the outer and inner frameworks 12 and 14 employ coupling mechanisms which are substantially the same, and, preferably, each comprise the hinge mechanism 36 and the latch mechanism 38. The hemispherical sections 16 and 18 of the outer framework 14 are connected along their respective rims 30 by the hinge mechanism 36, and the hemispherical sections 20 and 22 of the inner framework 12 are connected along their respective rims 30 by another hinge mechanism 36. Opposite the hinge mechanism 36 along the rim 30 of the outer hemispherical section 18 is the latch mechanism 38, and opposite the hinge mechanism 36 along the rim 30 of the inner hemispherical section 20 is another latch mechanism 38.

Figure 7:
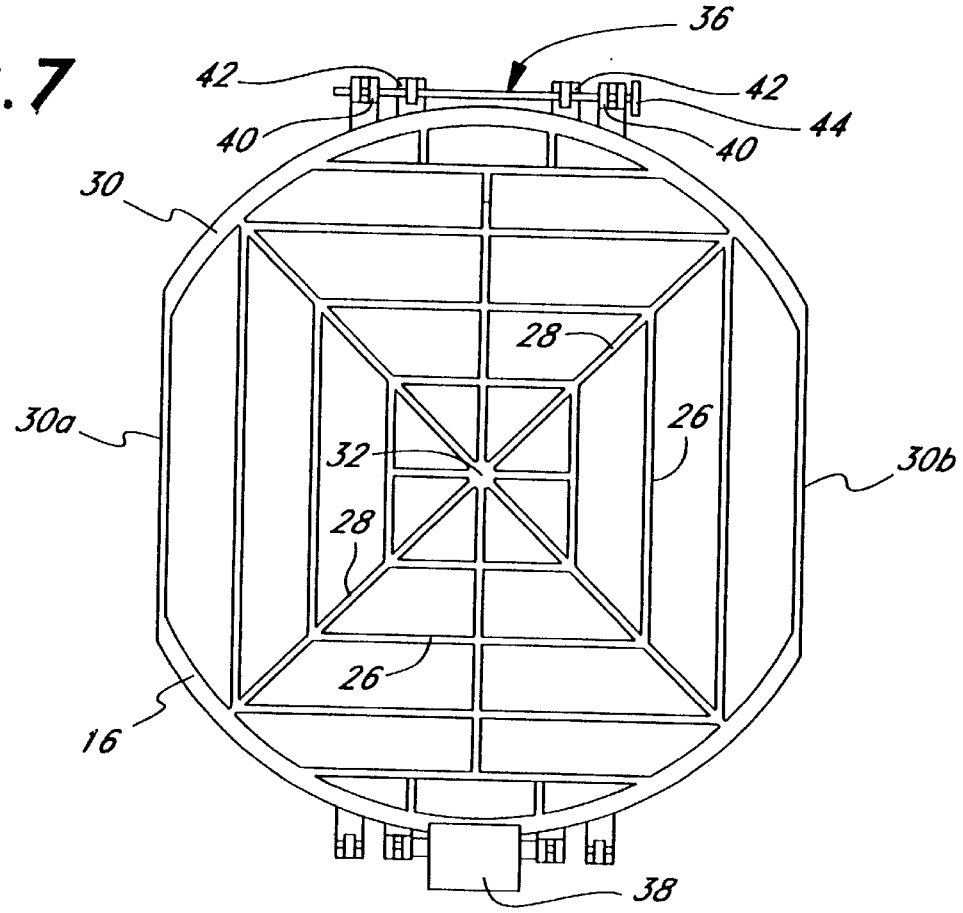
FIG. 7 is a plan view of the one hemispherical section of the outer framework.
Figure 12:
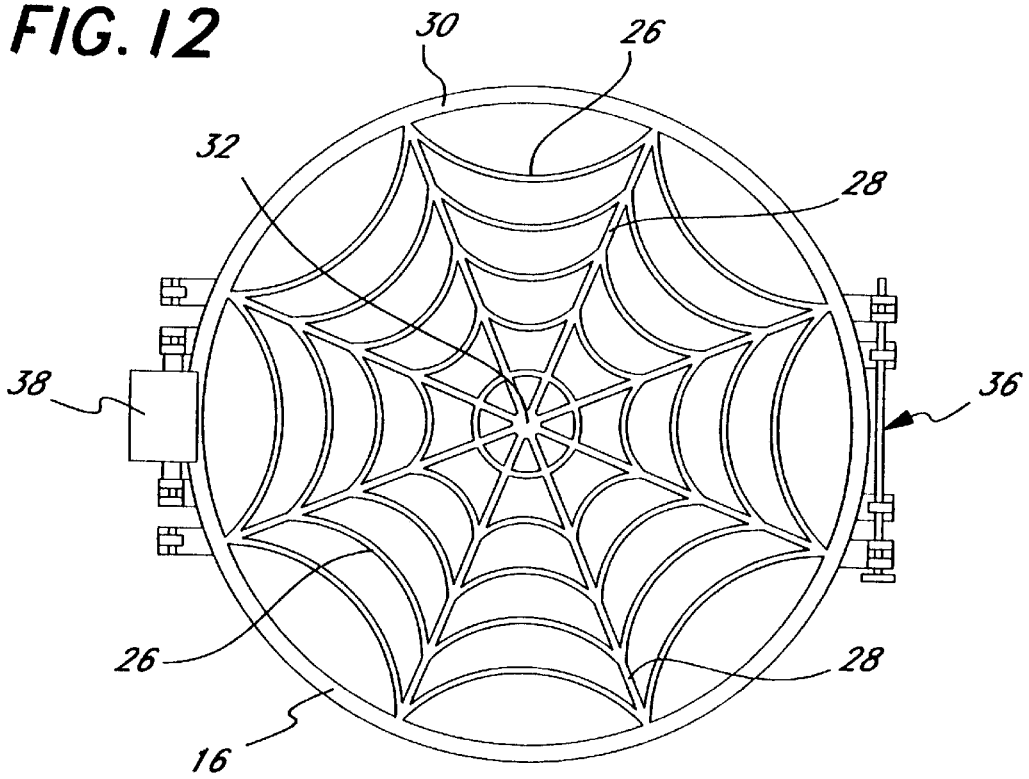
FIG. 12 is a plan view of the inner framework shown in FIG. 11.
Figure 8:
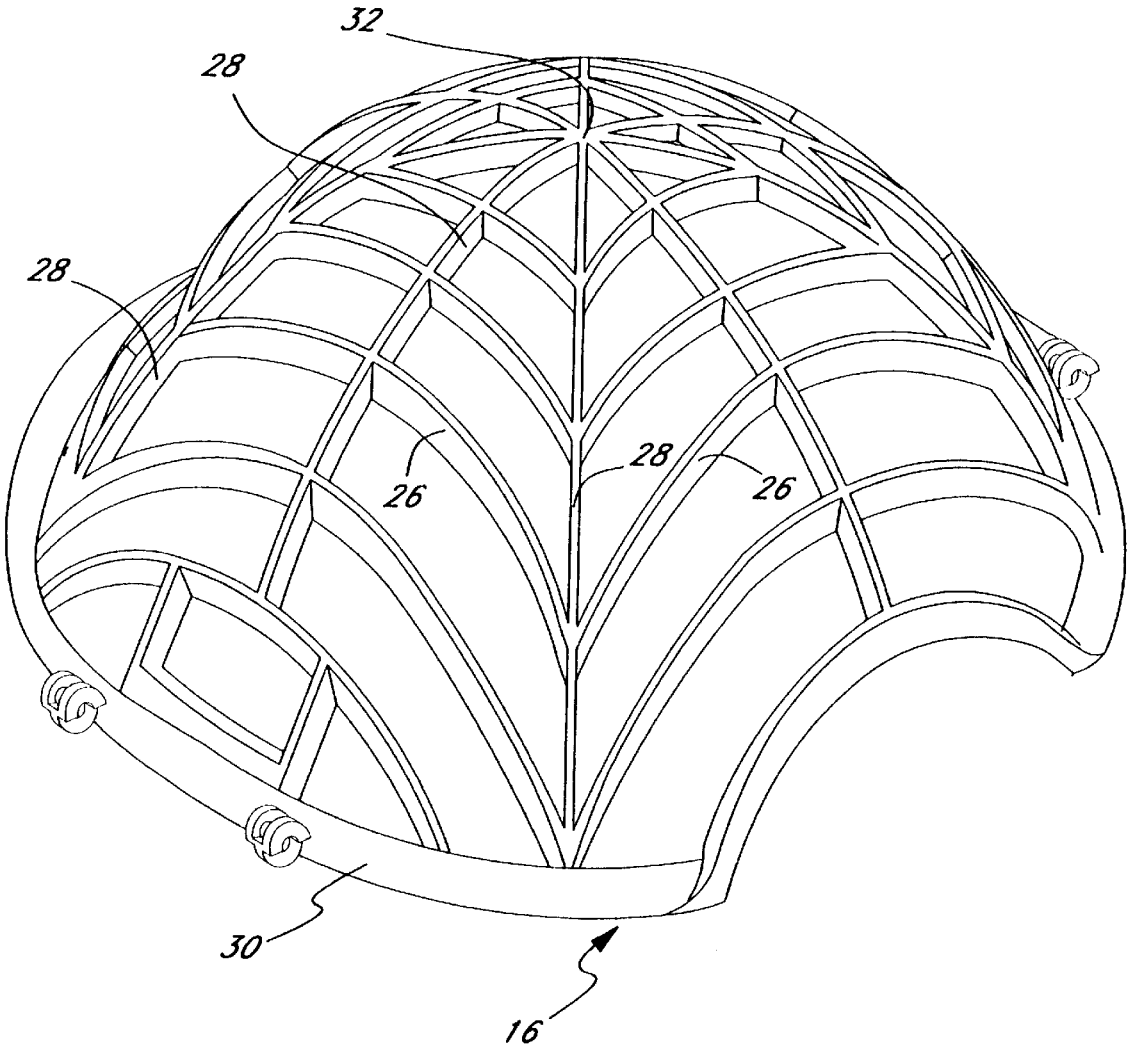
FIG. 8 is a perspective view of the one hemispherical framework of the outer framework.
Figure 9:
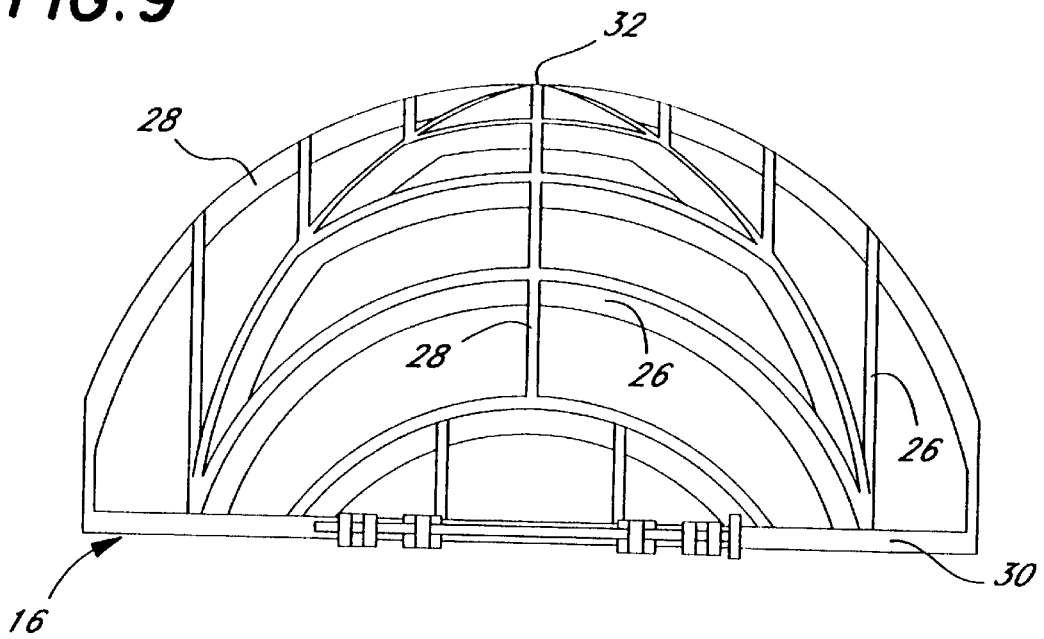
FIG. 9 is a side elevational view of the one hemispherical section of the outer framework.
Figure 10:
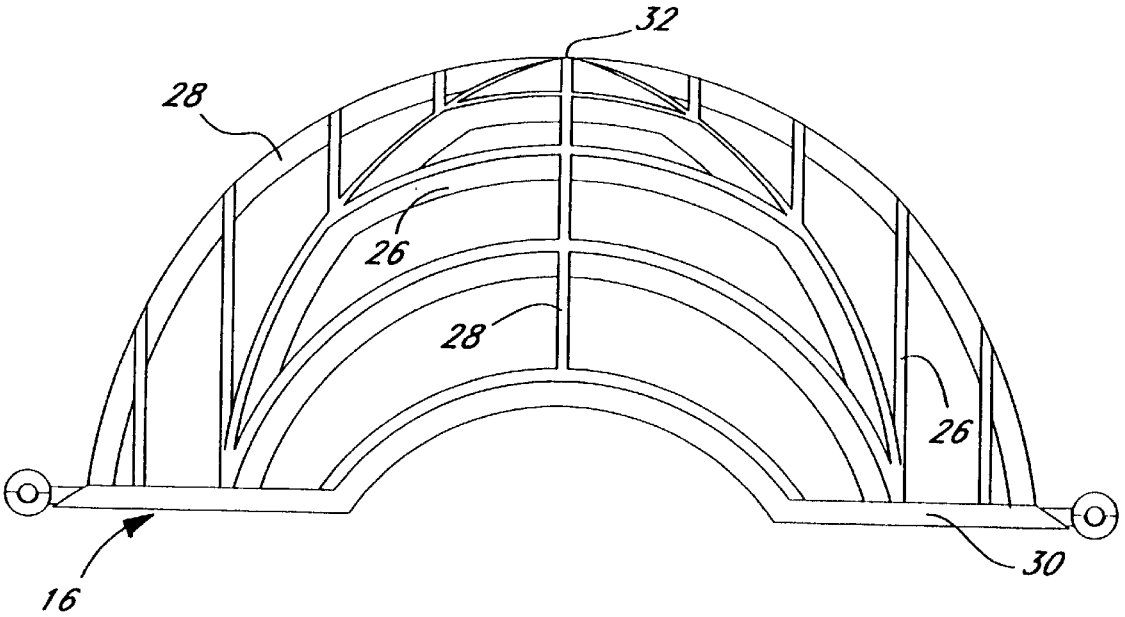
FIG. 10 is a side elevational view looking at the opposite side of the outer framework is shown in FIG. 9.
Figure 11:
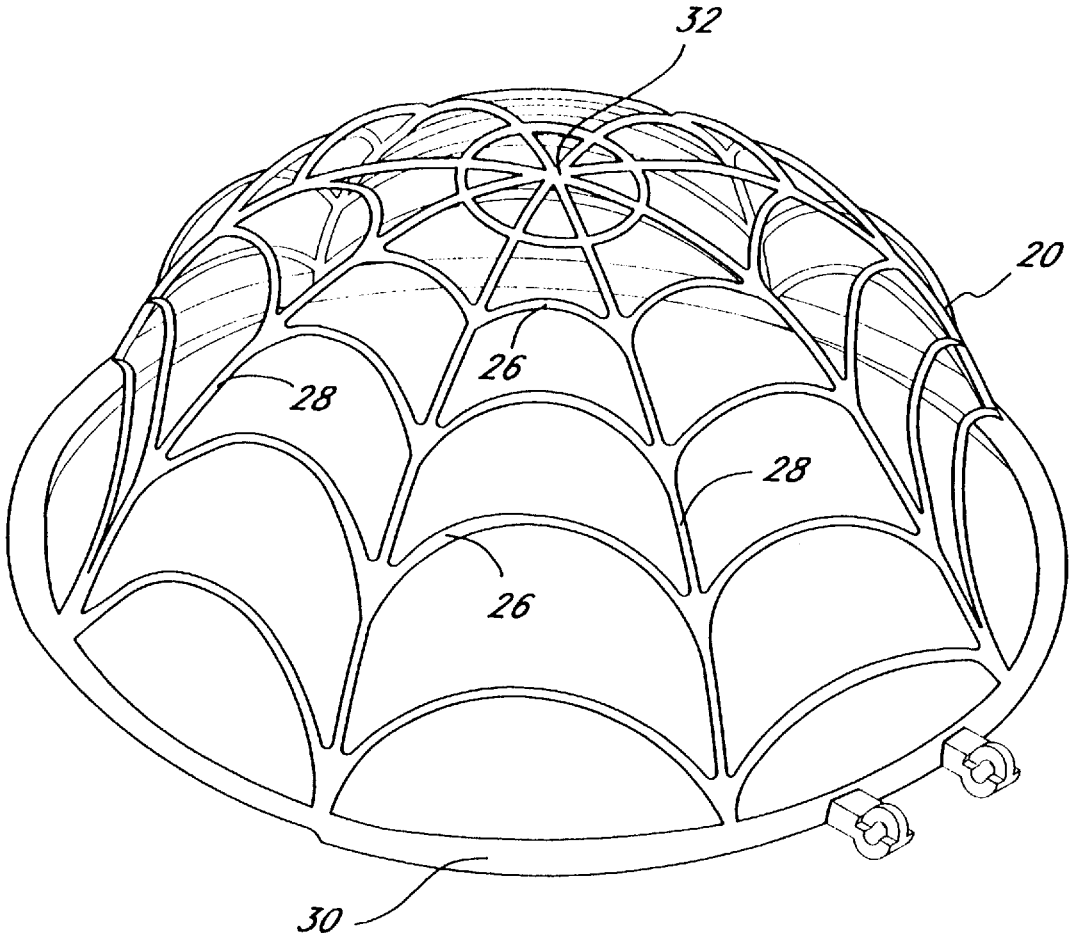
FIG. 11 is a perspective view of the inner framework.
Figure 13:
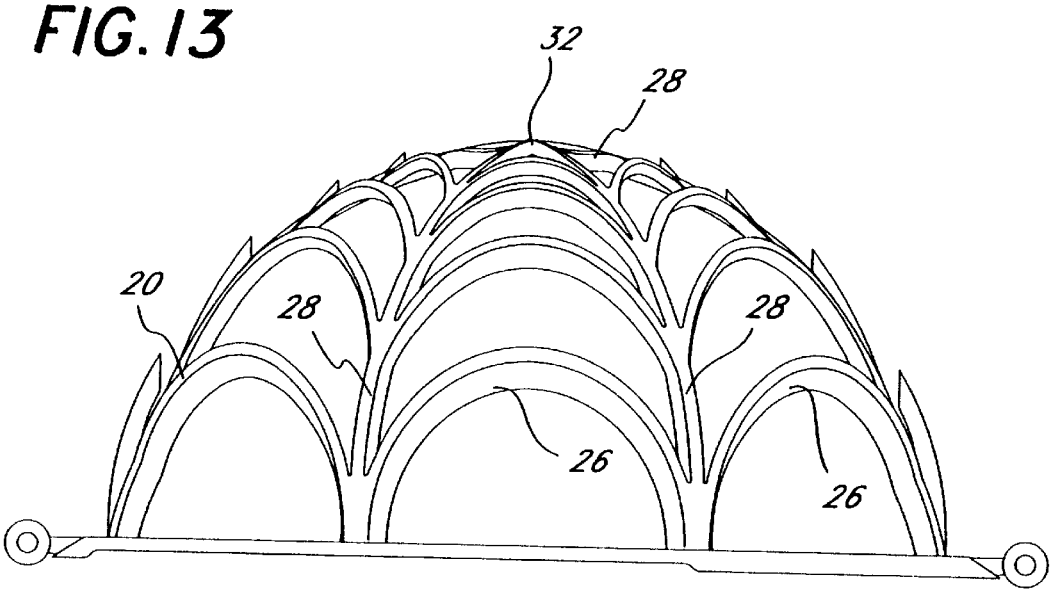
FIG. 13 is a side elevational view of the inner framework shown in FIG. 11.
Figure 14:
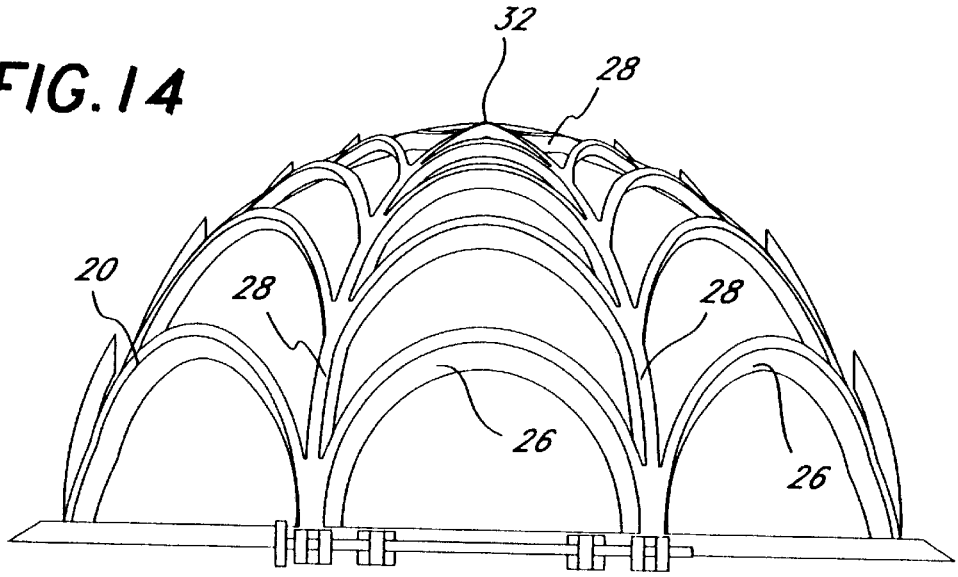
FIG. 14 is side elevational view looking at the opposite side of the inner framework is shown in FIG. 13.
Figure 18:
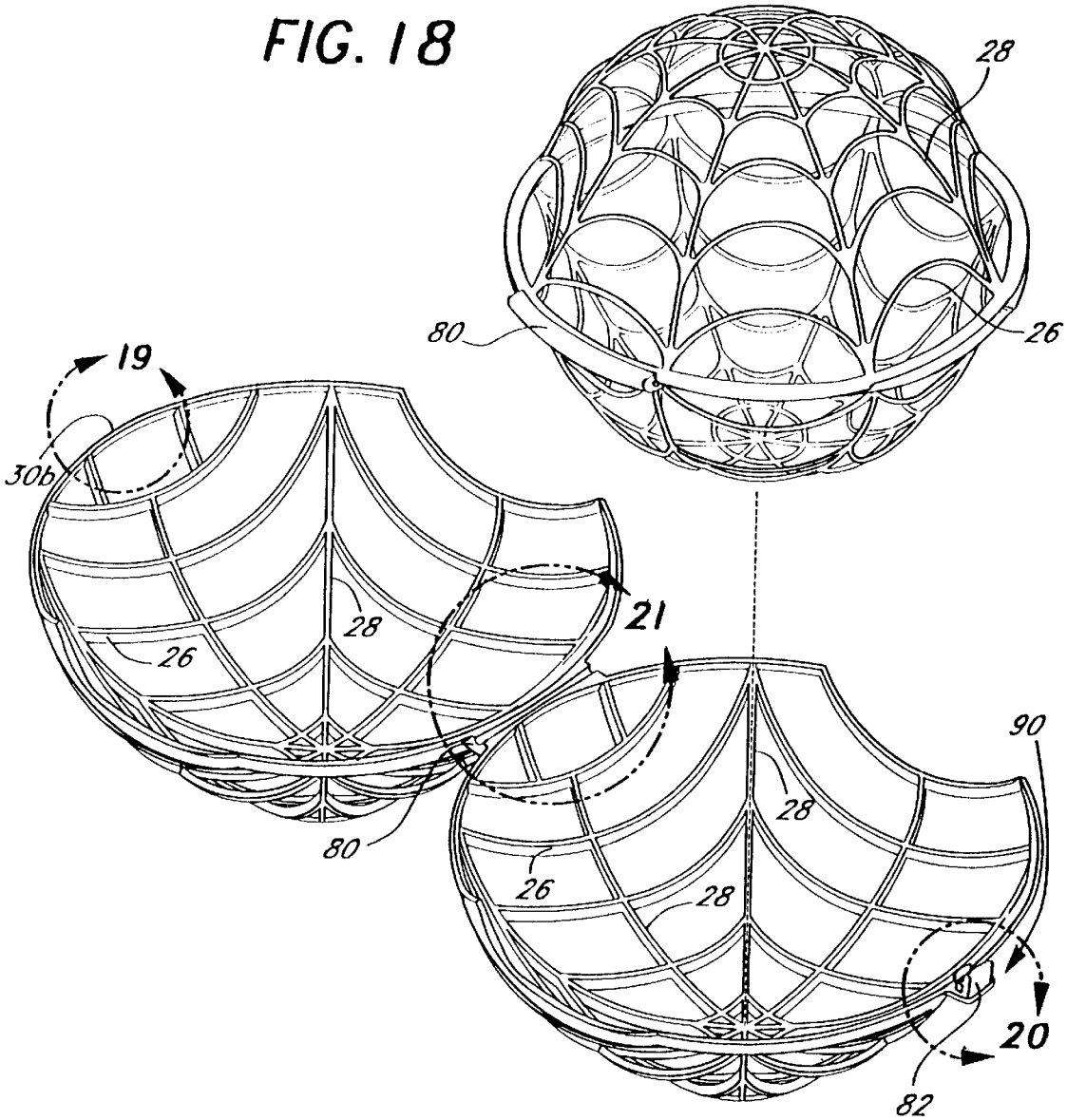
FIG. 18 is an exploded perspective view of an alternate embodiment of this invention showing an outer framework opened along a living hinge and an inner spherical framework positioned to be inserted in the open outer framework.
Figure 19:
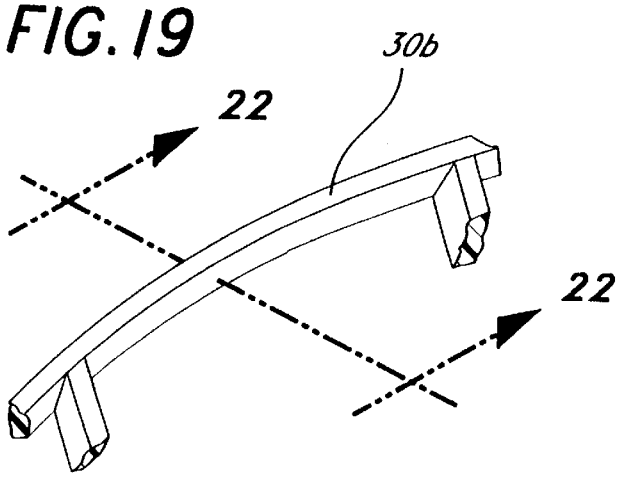
FIG. 19 is perspective view of the portion of the outer framework encircled by line 19 of FIG. 18.
Figure 21:
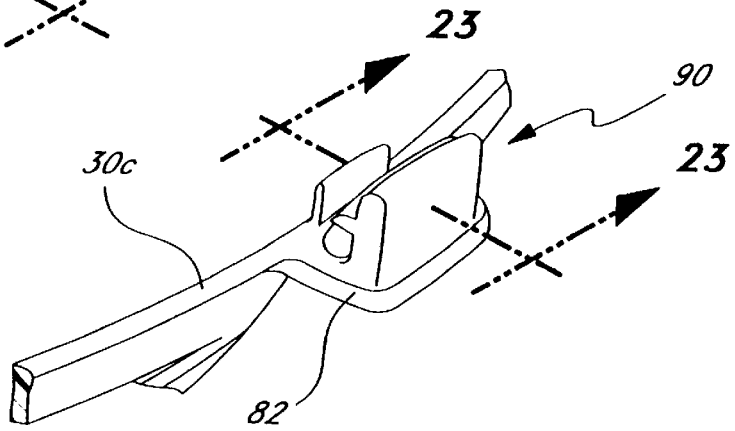
FIG. 21 is perspective view of the portion of the outer framework encircled by line 21 of FIG. 18.

As best shown in FIG. 7, each hinge mechanism 36 is of a conventional design employing spaced apart knuckles 40 and 42 on opposed rims. The knuckles 40 and 42 have aligned holes (not shown) therein with a removable hinge pin 44 extending through the holes. As best shown in FIGS. 15, 16, and 17, each latch mechanism 38 includes a pair of knuckles 46 and 48 on the same rim and a thumb lever 50 with a gripping finger 52 extending from a base 54 that has an elongated passageway 56 therein. The knuckles 46 and 48 each have aligned holes 59 therein, and a removable rod 58 extends through these holes 59 in the knuckles and the passageway 56. There are mating flat lands 60 and 62, respectively, in the knuckles 46 and 48 and the base 54 which engage upon assembly, so that the base does not move with respect to the knuckles. The thumb lever 50 is, however, flexible so that by pressing against it causes it to flex and then return to its unflexed condition upon release of the pressure. As depicted in FIG. 15, normally the finger 52 of the thumb lever 50 engages an extended portion 30*a* of the rim 30 immediately opposite it and grips this rim portion. To unlatch, the user simply presses against the thumb lever 50 to release its grip on the rim portion 30*a*.

The inner framework 12 is similar to the outer framework 14 except it is slightly smaller and it does not have opposed openings 33 and 35. Also, as previously mentioned, the shape and number of arches 26 and ribs 28 in the hemispherical sections 20 and 22 inner framework 12 is different than the shape of arches and ribs in the hemispherical sections 16 and 18 of the outer framework 14. This is to assist the user in distinguishing the hemispherical sections of the outer framework 14 from the hemispherical sections of the inner framework 12.

In the embodiment of this invention shown in FIGS. 1 through 17, the hemispherical sections 16, 18, 20, and 22 are all detachable one from another and are adapted to be stacked together on top of each other for packaging in a compact fashion. The pins 44, rods 58 and thumb levers 50 may also be separate, but contained within the same package. When the user opens the package, he or she will be able to quickly assemble the device 10 by simply fitting the pins 44 into the knuckles 40 and 42 and the rods 58 into the thumb levers 50.

Figure 4A:
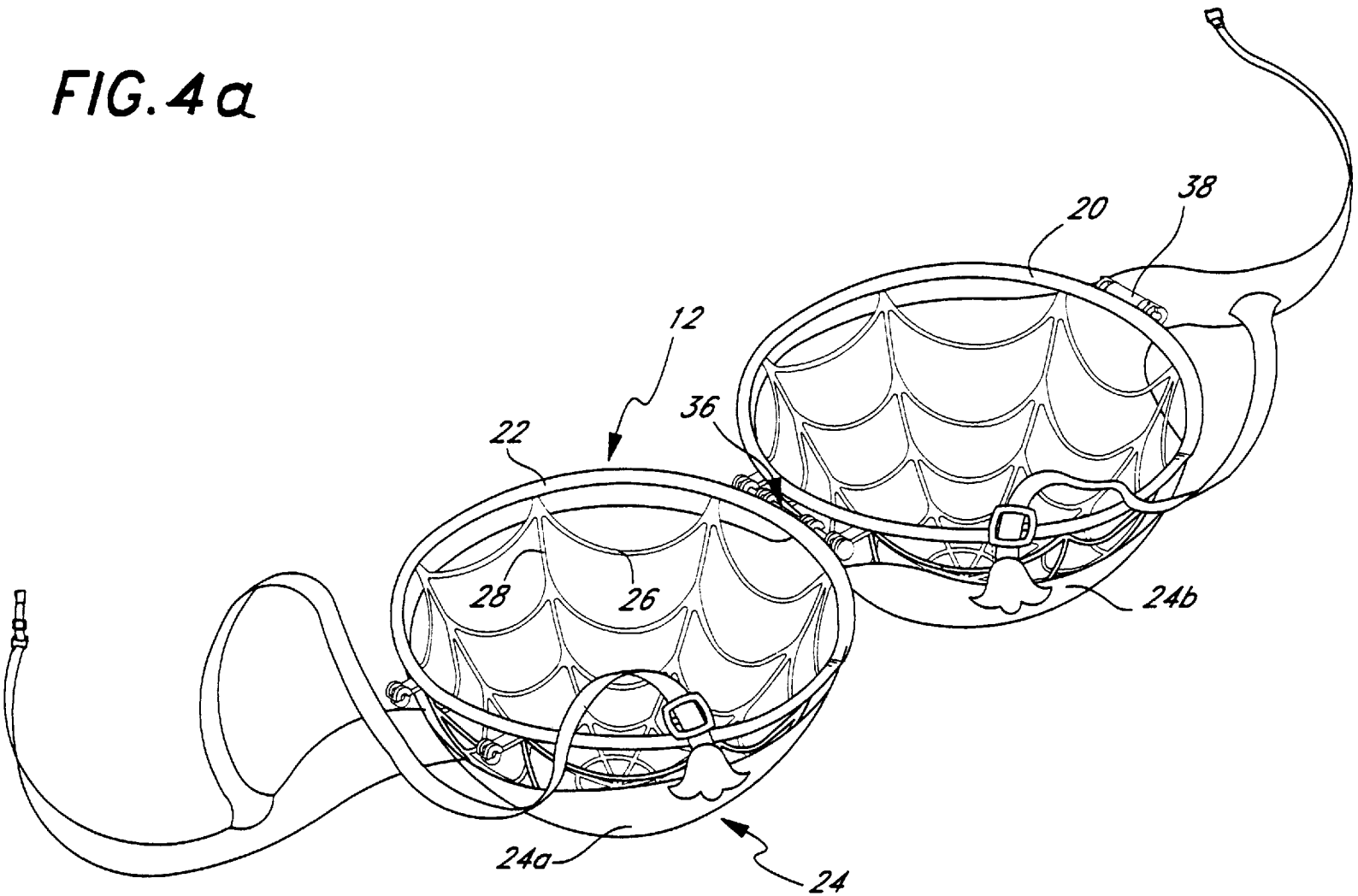
FIG. 4*a* is a perspective view similar to that shown in FIG. 3 with an individual hemispherical section of the inner framework inserted into each cup of the brassiere.
Figure 5A:
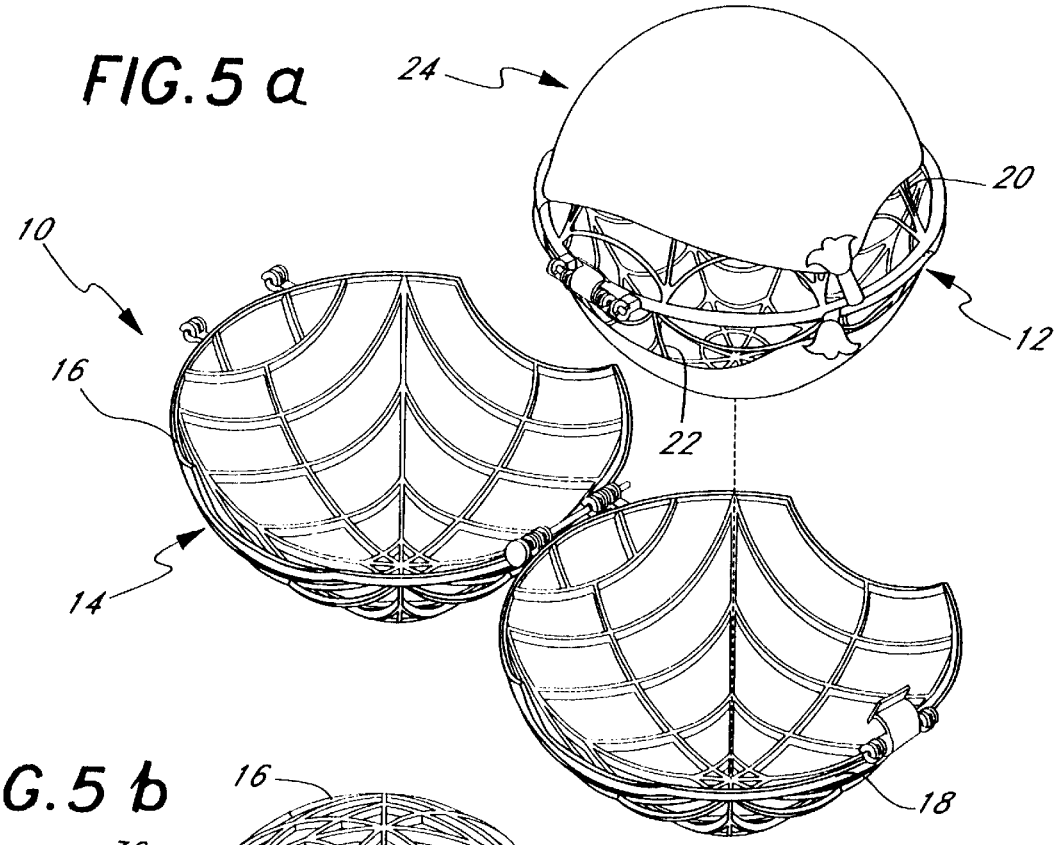
FIG. 5*a* is a perspective view showing the inner framework with the brassiere on the exterior of the framework and panties contained within it being placed within the open outer framework.
Figure 5B:
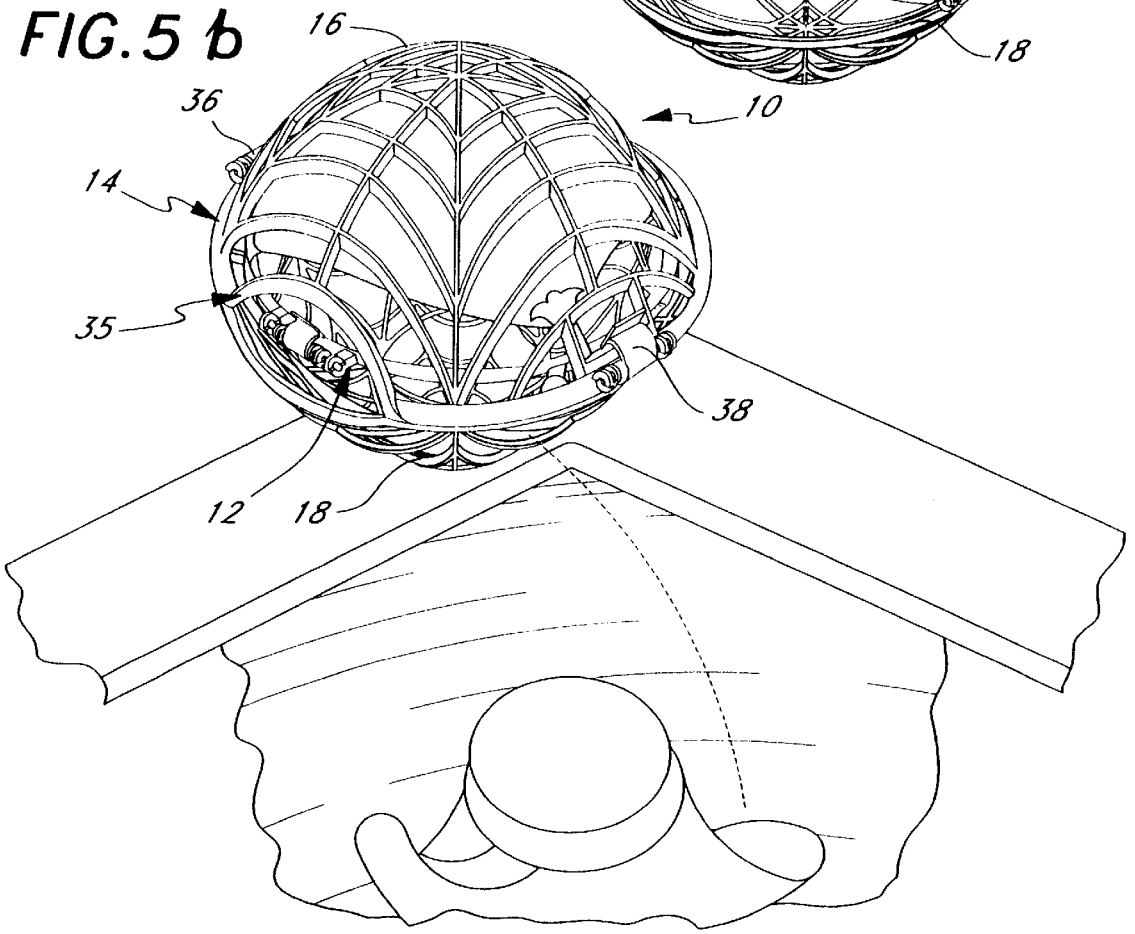
FIG. 5*b* shows an assembly of the inner framework with brassiere thereon and containing panties and the outer framework enclosing the inner framework being placed in a washing machine.
Figure 6:
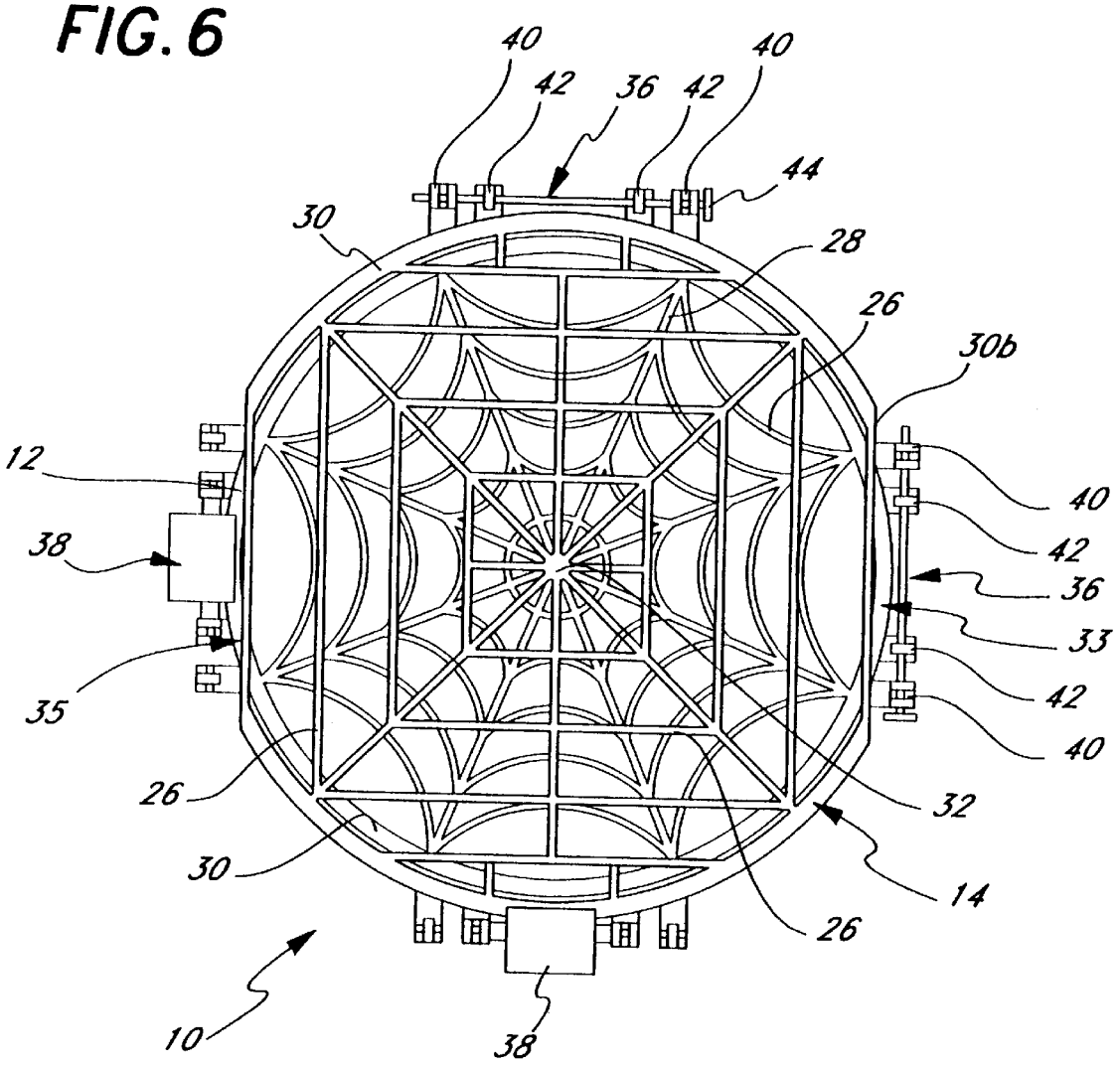
FIG. 6 is a plan view of the assembly of the inner and outer frameworks.

The hinge and latching mechanisms 36 and 38 on opposite sides of the rims 30 allow the inner framework 12 to be opened as shown in FIG. 4*a* and 4*b* so that the brassiere 24 can be fitted over this framework 12 with one hemispherical section being pushed inside each cup 24*a* and 24*b* of the brassiere. When this is accomplished, the two hemispherical sections 20 and 22 are closed as shown in FIGS. 4*c* and 4*d*. When closed, they provide an enclosure which can be used, for example, to hold delicate garments such as panties 70 (FIGS. 4*b* and 4*d*).

Figure 20:
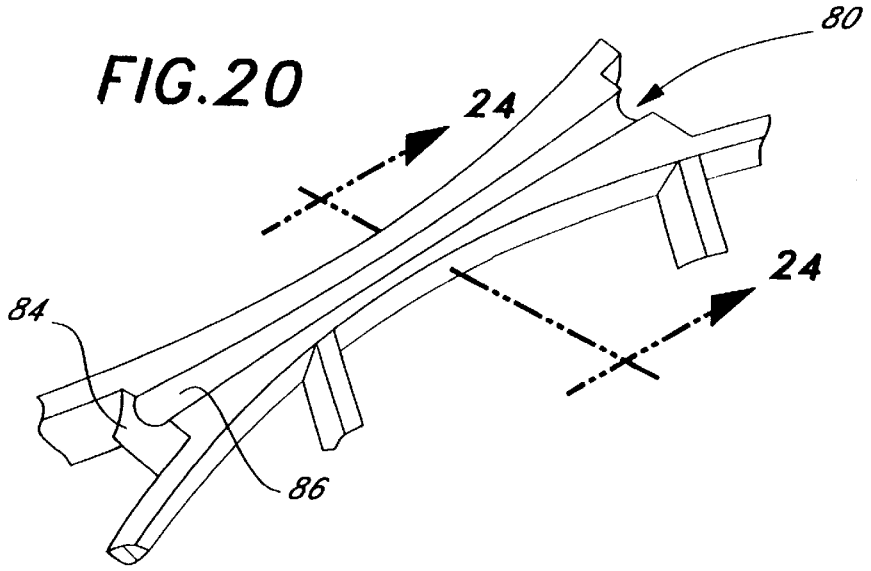
FIG. 20 is perspective view of the portion of the outer framework encircled by line 20 of FIG. 18.
Figure 25:
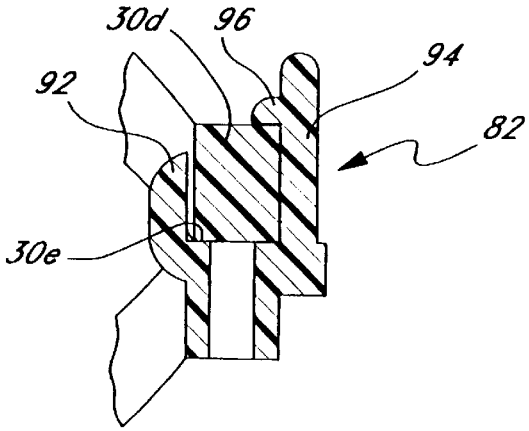
FIG. 25 is a cross-sectional view showing the latching mechanism coupling together the two sections of the outer framework depicted in FIG. 18.
Figure 26:
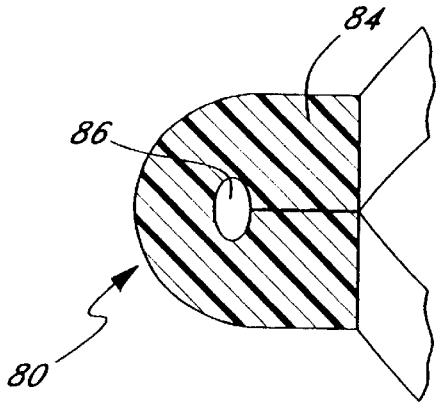
FIG. 26 is a cross-sectional view of the living hinge of the outer framework depicted in FIG. 18 when the two sections of the framework are closed.

An alternate embodiment of this invention is depicted in FIGS. 18 through 26, where a different type of hinge mechanism 80 and latching mechanism 82 is employed. In this arrangement, the hinge mechanism 80 is a conventional living hinge formed during the molding process and is integral with each pair of hemispherical sections 16 and 18 and 20 and 22, as the case may be. As illustrated in FIG. 20, the hinge mechanism 80 comprises an elongated strip 84 of material attaching complementary hemispherical sections together. There is an elongated groove 86 along the longitudinal axis of the strip 84 that reduces the thickness of the strip along the groove When the hemispherical sections are closed to form a spherical framework, either framework 12 or 14, the strip folds along the groove 86 as depicted in FIG. 26.

Figure 22:
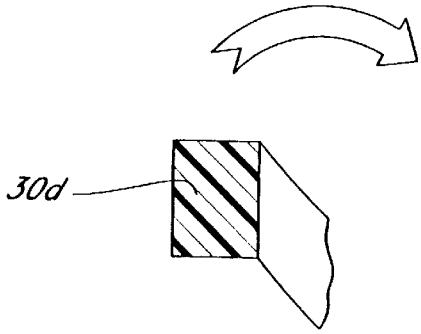
FIG. 22 is a cross-sectional view taken along line 22—22 of FIG. 19.
Figure 23:
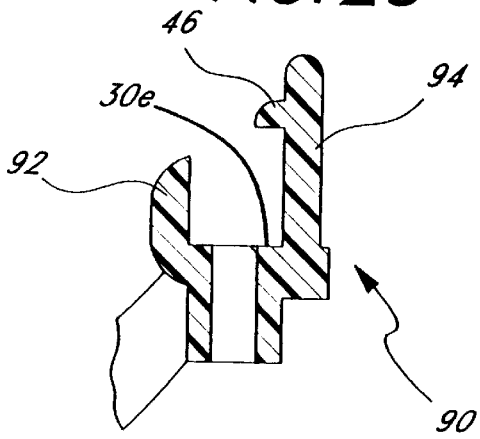
FIG. 23 is a cross-sectional view taken along line 23—23 of FIG. 19.
Figure 24:
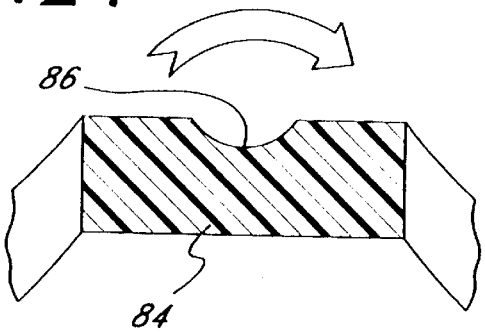
FIG. 24 is a cross-sectional view taken along line 24—24 of FIG. 19.

As best illustrated in FIGS. 22, 23 and 25, the latching mechanism 82 includes a portion of a rim 30*b* of either an outer or inner hemispherical section and a gripper member 90 including a pair of spaced, substantially parallel finger elements 92 and 94 extending outward from another rim portion 30*c*. The one finger element 94 is longer than the finger 92, and it includes a lip 96 at an angle of 90 degrees with respect to the finger 94. When the gripper member 90 is pushed against the rim portion 30*b* of the complimentary hemispherical section, this rim portion snaps into place between the fingers 92 and 94. As shown in FIG. 25, the rim portion 30*b* is thus wedged between the under side of the lip 96 and the fingers 92 and 94 to hold the two sections together. The finger 94 is flexible and may be pushed outward so that the rim portion 30*b* can be released from the grasp of the gripper member 90.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

I claim:

1. A device used during washing to protect a brassiere, including an inner framework over which the brassiere fits, and an outer framework in which the inner framework is contained, said outer framework including a plurality of sections that are coupled together, said sections, when coupled together, providing an enclosure for the inner framework and, when uncoupled, opening to receive the inner framework with the brassiere thereon, said inner and outer frameworks being open structures that allow water to flow thereto during washing.

2. The device of claim 1 where the outer framework has a substantially spherical configuration.

3. The device of claim 1 where the inner framework has a substantially spherical configuration.

4. The device of claim 3 where the inner framework includes two substantially hemispherical sections, and the brassiere has a pair of cups, one cup fitting snugly over each one of said hemispherical sections.

5. The device of claim 1 where the inner and outer frameworks are molded from a polymeric material.

6. The device of claim 5 where polymeric material is a copolymer of polypropylene and polyethylene, polypropylene, or polyethylene.

7. The device of claim 1 where the inner and outer frameworks are substantially spherical in configuration, and the two sections of the inner and outer frameworks are each separate, substantially hemispherical units, at least one of the sections including a latching mechanism for coupling together the two sections.

8. The device of claim 7 where the two sections of the inner and outer frameworks are hinged together.

9. A device used during washing to protect a brassiere which has a pair of cups, including an inner, substantially spherical framework over which the brassiere fits, and an outer, substantially spherical framework in which the inner framework is contained, said inner and outer frameworks each including a pair of substantially hemispherical, complementary sections that are adapted to be coupled together to form a substantially spherical framework and uncoupled, the pair of sections of the outer framework, when coupled together, providing a first enclosure for the inner framework and, when uncoupled, opening to receive the inner framework with the brassiere thereon, the pair of sections of the inner framework, when uncoupled, each providing an external support over which one cup of the brassiere fits snugly, and, when coupled together, providing a second enclosure into which delicate garments may be placed, said inner and outer frameworks being open structures that allow water to flow thereto during washing.

10. The device of claim 9 where the inner and outer frameworks are molded from a polymeric material.

11. The device of claim 10 where polymeric material is a copolymer of polypropylene and polyethylene, polypropylene, or polyethylene.

12. The device of claim 9 where the sections of the inner and outer frameworks are each separate units, at least one of the sections of each pair, including a latching mechanism for coupling together complementary sections.

13. The device of claim 12 where the two sections of the inner and outer frameworks are hinged together.

14. A method of washing a brassiere in a washing machine, including the steps of (a) providing a device for protecting the brassiere, which has an inner framework over which the brassiere fits, and an outer framework in which the inner framework is contained, said outer framework including a plurality of sections that are coupled together, said sections, when coupled together, providing an enclosure for the inner framework and, when uncoupled, opening to receive the inner framework with the brassiere thereon, said inner and outer frameworks being open structures that allow water to flow thereto during washing, (b) fitting the brassiere over the inner framework, (c) after uncoupling the pair of sections of the outer framework, placing the inner framework with the brassiere thereon into the outer framework and coupling the pair of sections together to enclose the inner framework in the outer framework, and (d) placing in the washing machine the device with the outer framework enclosing the inner framework with the brassiere thereon.

15. The method of claim 14 where the outer framework has a substantially spherical configuration.

16. The method of claim 14 where the inner framework has a substantially spherical configuration.

17. The method of claim 16 where the inner framework includes two substantially hemispherical sections, and the brassiere has a pair of cups, one cup fitting snugly over each one of said hemispherical sections.

18. The method of claim 17 where the two substantially hemispherical sections of the inner framework upon being coupled together form a second enclosure for holding delicate garments.

19. The device of claim 14 where the inner and outer frameworks are substantially spherical in configuration, and the two sections of the inner and outer frameworks are each separate, substantially hemispherical units, at least one of the sections including a latching mechanism for coupling together the two sections.

20. The device of claim 19 where the two sections of the inner and outer frameworks are hinged together.

* * * * *